US006584675B1

(12) United States Patent
Rajan et al.

(10) Patent No.: US 6,584,675 B1
(45) Date of Patent: Jul. 1, 2003

(54) METHOD FOR FABRICATING THREE DIMENSIONAL TRAVELING WAVE TUBE CIRCUIT ELEMENTS USING LASER LITHOGRAPHY

(76) Inventors: Sunder S. Rajan, 6433 E. Look Out Lane, Anaheim, CA (US) 92807; James A. Dayton, Jr., 1718 Esplanade #203, Redondo Beach, CA (US) 90277

( * ) Notice: Subject to any disclaimer, the term of this patent is extended or adjusted under 35 U.S.C. 154(b) by 0 days.

(21) Appl. No.: 09/591,697

(22) Filed: Jun. 9, 2000

(51) Int. Cl.[7] ..... H01Q 13/00; H01J 25/34

(52) U.S. Cl. ..... 29/600; 29/592.1; 315/3.3; 315/3.6; 315/39.3; 333/162; 430/323; 427/271; 216/67

(58) Field of Search ..... 29/600, 592.1, 29/DIG. 47, 25.35, 599; 315/3.5, 3.6, 39.3; 333/161, 162, 156; 343/700 R, 731; 156/345; 430/323, 329; 427/271; 216/49, 67, 83, 100, 192.34

(56) References Cited

U.S. PATENT DOCUMENTS

| | | | | |
|---|---|---|---|---|
| 2,851,630 A | | 9/1958 | Birdsall | |
| 3,504,223 A | * | 3/1970 | Orr et al. | 315/3.5 |
| 3,508,108 A | * | 4/1970 | Salisbury | 315/3.5 |
| 3,610,998 A | * | 10/1971 | Falce | 29/600 |
| 3,610,999 A | * | 10/1971 | Falce et al. | 29/600 |
| 3,615,470 A | * | 10/1971 | Singletary, Jr. | 96/37 |
| 3,654,509 A | * | 4/1972 | Scott et al. | 315/3.5 |

(List continued on next page.)

FOREIGN PATENT DOCUMENTS

JP 200258923 A * 9/2000

OTHER PUBLICATIONS

Vidusek, D. "*Electrophoretic Photoresist Technology: An Image of the Future—Today*" (1989) Wela Publications, Ltd., Circuit World, vol. 15, No. 2 , pp. 5.

Kory, C., et al. "*Novel High–Gain, Improved–Bandwidth, Finned–Ladder V–Band Traveling–Wave Tube Slow–Wave Circuit Design*" (1995) IEEE, vol. 42, No. 9, pp. 1686–1692.

*Primary Examiner*—Peter Vo
*Assistant Examiner*—Minh Trinh
(74) *Attorney, Agent, or Firm*—Thomas F. Lebens; Fitch, Even, Tabin & Flannery

(57) ABSTRACT

A method for constructing thermally and dimensionally stable traveling wave tube circuits having high dimensional stability, narrow tolerances, and very small size by providing a small hollow preform constructed of a desired material which is coated with a layer of photoresist material then exposed to a UV laser to form a desired pattern mask in the photoresist layer. The pattern masked preform is then etched to create a preform having a desired shape. After shaping, the photoresist coating is stripped from said shaped preform to form a traveling wave tube circuit. Optionally the travel wave tube circuit may be polished. Additionally, the present invention contemplates an apparatus for forming small three dimensional circuit structures from preforms comprising a chuck for supporting the preform on its axis, a motor for rotating the preform, a UV laser for directing a beam onto the preform, a means for shifting the laser along said preform, and a controller for controlling the motors rate of rotation, the rate of movement along the length of the preform caused by shifting means, and whether the laser is on or off to achieve a predetermined pattern mask on the preform. Additionally, the present invention contemplates novel three dimensional structures including a very small helical traveling wave tube circuit, a ringed bar circuit structure, a finned ladder circuit structure, and a slotted finned ladder circuit structure as well as traveling wave tubes incorporating these structures.

20 Claims, 10 Drawing Sheets

U.S. PATENT DOCUMENTS

| | | | | | |
|---|---|---|---|---|---|
| 3,670,196 | A | | 6/1972 | Smith | |
| 3,693,038 | A | * | 9/1972 | Scott et al. | 315/3.5 |
| 3,972,005 | A | | 7/1976 | Nevins et al. | |
| 4,005,321 | A | | 1/1977 | Shibata et al. | |
| 4,115,721 | A | | 9/1978 | Friz | |
| 4,129,803 | A | * | 12/1978 | Friz | 315/3.5 |
| 4,229,676 | A | | 10/1980 | Manoly | |
| 4,268,778 | A | * | 5/1981 | Friz | 315/3.5 |
| 4,347,419 | A | * | 8/1982 | Jasper, Jr. | 29/600 |
| 4,465,988 | A | * | 8/1984 | Moats | 333/156 |
| 4,647,816 | A | * | 3/1987 | Heynisch | 315/3.5 |
| 4,820,688 | A | * | 4/1989 | Jasper, Jr. | 505/855 |
| 5,112,438 | A | | 5/1992 | Bowers | 156/655 |
| 5,231,330 | A | * | 7/1993 | Karsten | 315/3.5 |
| 5,786,306 | A | * | 7/1998 | Gao et al. | 29/599 |

* cited by examiner

METHOD FOR FABRICATING THREE DIMENSIONAL TRAVELING WAVE TUBE CIRCUIT ELEMENTS USING LASER LITHOGRAPHY

TECHNICAL FIELD

The present invention relates to the fabrication of small three dimensional structures, particularly to the fabrication of three dimensional circuit structures used in traveling wave tubes, and most specifically to methods for fabricating helical circuit structures for use in traveling wave tubes.

BACKGROUND OF THE INVENTION

In traveling wave tubes (TWT's) an electron beam interacts with a propagating electromagnetic wave to amplify the energy of the electromagnetic wave. To achieve the desired interaction between the electron beam and the electromagnetic wave, the electromagnetic wave is propagated through a structure which slows the axial propagation of the electromagnetic wave and brings it into synchronism with the velocity of the electron beam. In a TWT, one such so-called slow wave is a helical coil that surrounds the structure of the electron beam. The kinetic energy in the electron beam is coupled into the electromagnetic wave, amplifying the wave significantly. The advantages of such slow wave properties in TWT's are known to those having ordinary skill in the art.

A wide variety of alternative slow wave structures are known. For example, those structures disclosed in U.S. Pat. Nos. 3,670,196, 4,115,721, 4,005,321, 4,229,676, 2,851,630 and 3,972,005. A number of methods for constructing the helixes of these structures are known. Common fabrication techniques include winding or machining. For example, a thin wire or tape of electrically conductive material may be wound around a mandrel and processed to properly shape the helix to the circular configuration of the mandrel. However, the process of winding the helix places stress on the wired tape, creating a helix of limited stability under operating conditions. Additionally, when heated (for example during annealing or during operation), such wound helixes do not have dimensional stability (i.e. helices formed in this manner have a tendency to distort beyond the tolerances required for reliable operation).

Alternatively, a cylindrical helix may be cut into the desired pattern using electron discharge machining. This process does not produce helices of accurate dimensions. However, this process tends to produce helices that are embrittled and subject to cracking.

Although suitable for some purposes, both machining and winding techniques are subject to serious limitations only capable of reliably manufacturing helixes of relatively large dimensions. However, when used in high frequency applications (for example, so-called "Ka-band", "Q-band", "V-band", or "W-band" TWT's) such conventional techniques do not reliably produce the smaller helixes and circuit structures that are needed for these high frequency applications. For example, in a TWT operating in millimeter wavelengths, at frequencies above 20 GHz, conventional techniques produce TWT circuits that suffer noticeably from mechanical distortion effects and thermo-mechanical relaxation. At frequencies near, for example, 50 GHz, the circuit components (including the helix) are so small that conventional manufacturing techniques can produce satisfactory helixes with only with great difficulty and with often unpredictable quality. A typical traveling wave circuit element features a coaxial dielectric support element which is in physical contact with the circuit element. Due to the effects of mechanical distortion or thermo-mechanical relaxation, conventionally constructed circuit elements physically distort and become separated from the dielectric support. This is undesirable. Also, at these frequencies current processes for manufacturing helixes commonly have a very low product yield. An additional limitation to existing methods of manufacturing are the inability to produce certain advantageous non-helical circuit structures. In short, current manufacturing processes produce helices which are plagued with poor tolerances, dimensional inaccuracies, size limitations, circuit unreliability, and insufficient robustness to service the needs of high frequency TWT's. Additionally, a number of non-helical circuit structures have been proposed by others. The problem with many of these structures is that until now there has been no satisfactory way to construct them for operation at high frequency.

SUMMARY OF THE INVENTION

Accordingly, it is the feature of this invention to provide methods and apparatus for constructing small three dimensional circuit structures having precise physical dimensions to narrow tolerances. It is a further feature of the invention to construct structures demonstrating high dimensional stability and robustness. Structures formed in accordance with the present invention also demonstrate improved thermal performance, reduced rf losses, and increases in overall performance efficiency. A particular feature of the present invention to provide a methodology for constructing thermally and dimensionally stable helical circuit elements for use in TWT's to exacting tolerances at very small dimensions. It is a further feature of the present invention to provide methods of fabricating heretofore unbuildable circuit elements as well as methods for constructing such elements.

The principles of the present invention contemplate methods for constructing thermally and dimensionally stable three-dimensional TWT circuit structures to narrow tolerances and very small sizes by providing a small hollow preform constructed of a desired material. A coating of photoresist material is applied to the preform. The photoresist coating is treated to form a desired pattern in the photoresist coating such that a portion of the outside surface of the preform is exposed and another portion of the outside surface of said preform remains covered with the photoresist pattern. Subsequently, preform material is removed from the exposed portion of said preform leaving the pattern covered portion in place to create a preform having a desired shape. After shaping, the photoresist coating is stripped from said shaped preform, followed by an optional polishing step.

Additionally, the principles of the present invention contemplate an apparatus for forming small three dimensional circuit structures from preforms comprising a means for supporting the preform on its axis, a means for rotating the preform, an exposure source for directing a light beam onto said preform, a means for shifting said exposure source along said preform, and a means for controlling said rotating means, said shifting means, and said exposure source to achieve a predetermined pattern in the preform.

Also, the principles of the present invention as described above contemplate novel three dimensional structures including a very small helix, a ring bar circuit, a very small finned ladder circuit structure, and a very small slotted finned ladder circuit structure as well as traveling wave tubes incorporating these structures.

Other features of the present invention are disclosed or made apparent in the section entitled "DETAILED DESCRIPTION OF THE INVENTION".

BRIEF DESCRIPTION OF THE DRAWINGS

For a fuller understanding of the present invention, reference is made to the accompanying drawings in the following "Detailed Description of the Invention". Reference numbers and letters refer to the same or equivalent parts of the invention throughout the several figures of the drawings. In the drawings.

DETAILED DESCRIPTION OF THE INVENTION

The principles of the present invention may be used to advantageously construct small three dimensional circuit structures having precise physical dimensions to exacting tolerances. Furthermore, such structures are free of the mechanical stresses common to conventionally fabricated structures. Moreover, the structures of the present invention demonstrate the advantageous features of high dimensional stability and robustness.

The following description of the presently contemplated best mode of practicing the invention is not to be taken in a limiting sense, but is made merely for the purpose of describing the general principles of the invention. The scope of the invention should be determined with reference to the claims.

Embodiments of the present invention are used to construct helical circuit structures for use in traveling wave tubes (TWT's) having inside diameters in the range of about 0.018 inches (18 mils) to about 0.125 inches (125 mils) with helical wall thicknesses being in the range of about 4–10 mils. The principles of the present invention have particular usefulness when applied to electrically conductive and etchable materials including without limitation, copper, molybdenum, tungsten, and alloys containing these metals. The principles of the present invention are not confined to the above referenced material but may be applied to any etchable metal and may also be applied to semiconductor materials or other non-conducting materials.

Figure 1A:
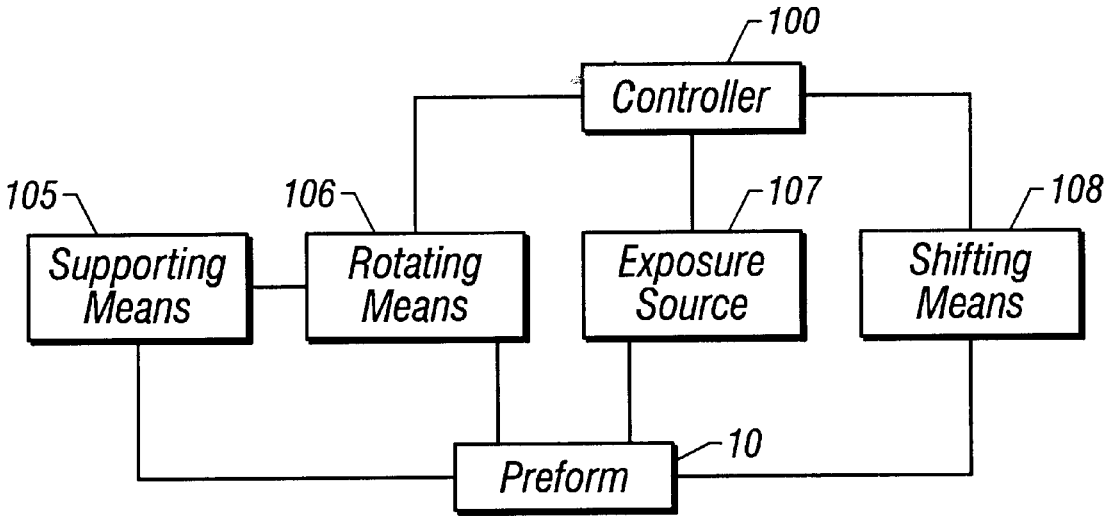
FIG. 1A is a block diagram of one embodiment of a device that may be used to form photoresist patterns in accordance with the principles of the present invention.

FIG. 1A is a simplified block diagram depicting an embodiment that may be used to construct the three-dimensional structures of the present invention. The apparatus of FIG. 1A includes a means for supporting 105 a preform 10 on an axis, a means for rotating 106 the preform 10, an exposure source 107 for directing a light beam onto said preform 10, a means for shifting 108 said exposure source 107 along said preform 10, and a means for controlling 100 said rotating means 106, said shifting means 108, and said exposure source 107 to achieve a predetermined pattern in the preform 10. The circuit structures disclosed herein may be readily integrated into traveling wave tubes. The methods for constructing such tubes are within the skill of one having ordinary skill in the art.

Figure 1B:
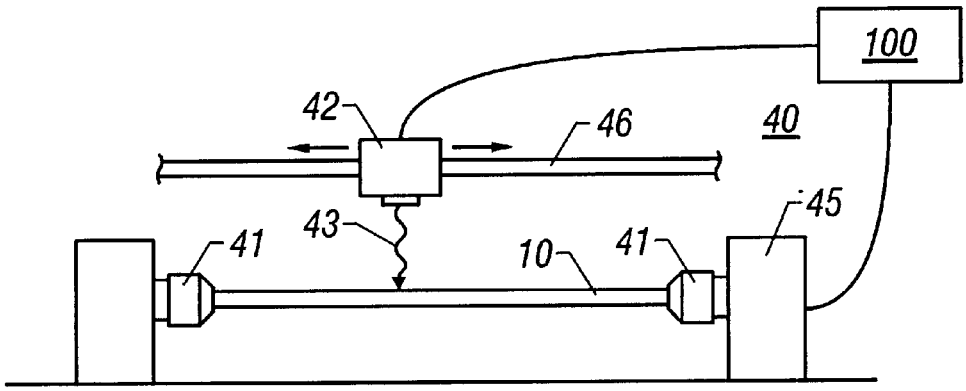
FIG. 1B is a schematic illustration of a device that may be employed to form photoresist patterns in accordance with the principles of the present invention.

A simplified illustration of an apparatus that may be used in constructing the three-dimensional structures of the present invention is shown in FIG. 1B. Included is a photoresist treated preform 10 supported in a pair of chucks 41 and driven by a controlled motor 45. An optical assembly (also referred to as the exposure source) 42 mounted upon a guide 46 which facilitates shifting the source 42 longitudinally (as indicated by the arrows) along the preform 10. The rate of rotation of the preform 10 and the rate of movement of the optical assembly 42 is typically determined by a controller (not shown). The optical assembly 42 typically includes an optical source, for example, an ultraviolet (UV) excimer laser such as a LPX 210 manufactured by Lambda Physik. A wide variety of other lasers known to those having ordinary skill in the art may be chosen. Additionally, a variety of optical sources may be used, for example, a Xenon lamp with a focusing lens and a mask. A UV laser is merely a preferred source due to its coherent radiation and ability to define sharp features in the photoresist.

The apparatus of FIG. 1B directs an exposing light beam 43 from an optical source contained within the optical assembly onto a preform 10 which has already been treated with a layer of photoresist. By controlling the rate at which the optical assembly (e.g., a laser) 42 is longitudinally shifted (as shown by the arrows) along the preform 10 and the rate of rotation of a variable speed motor 45 (and thereby the rate of rotation of a preform 10) an exposure pattern may be formed in the photoresist layer of the preform 10. In addition, by switching the optical source off and on during exposure, more complicated and discontinuous patterns may be formed in the photoresist layer. The contour of these patterns are determined by an encoder pattern which is supplied to the controller 100. Controllers 100 of the present invention can be a simple mechanically actuated controllers or microprocessor driven controllers (e.g, computers) or even application specific integrated circuits (ASIC's). The encoder pattern can be either hardware or software driven and may be adjusted during processing to accommodate the needs of the manufacturer.

Figure 2:
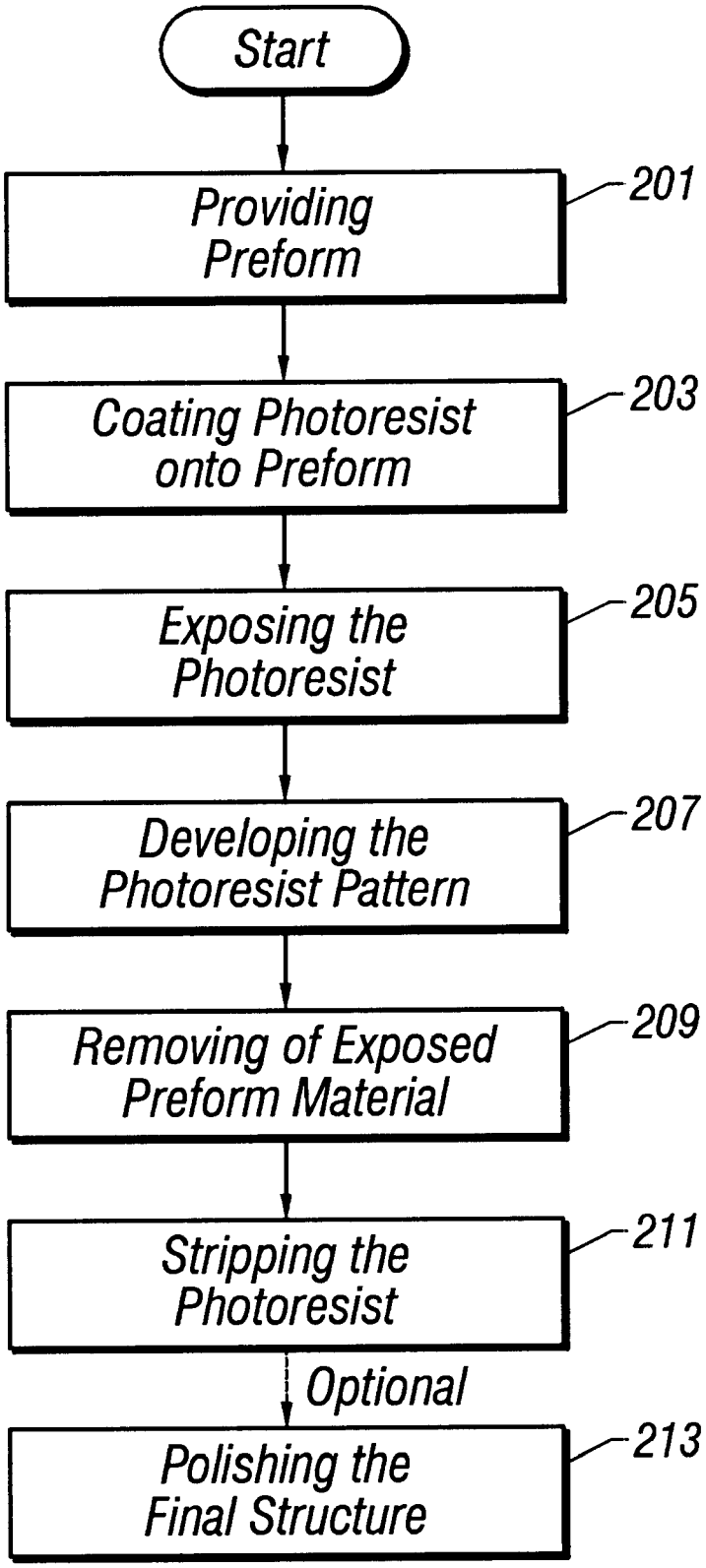
FIG. 2 is a flowchart illustrating one method of constructing a three dimensional circuit structure in accordance with the principles of the present invention.
Figure 3:
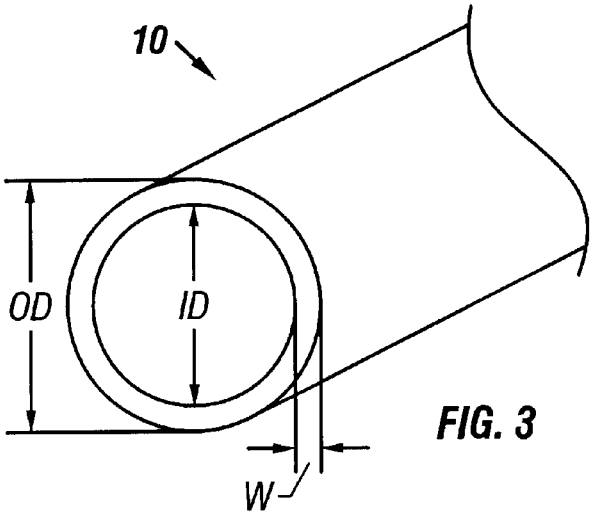
FIGS. 3 and 4 are perspective views of hollow preform shapes for use in accordance with the principles of the present invention.

FIG. 2 illustrates one embodiment of a process flow for forming a helical circuit structure for use in TWT's. A hollow preform is provided (Step 201). The preform may be of any shape depending on the desired final shape of the structure. Referring to FIG. 3, a preferred preform 10 is a substantially cylindrical hollow tube, having an inner diameter ID and an outer diameter OD. The walls 11 of the tube 10 have a width W. In one preferred embodiment a molybdenum preform 10 has an inner diameter ID of about 18 mils and an outer diameter OD of about 23 mils. The walls have a thickness W in the range of about 4–6 mils. Such precision preforms can be obtained, for example, by forming a larger tube and in a controlled process drawing the tube down to a nominal size. Then the outside diameter is precision ground to the needed tolerance and the inside diameter is electron discharge machined to the precision tolerance required. In widest application the preform 10 may be constructed of any readily etchable material, but preferred materials include molybdenum or molybdenum containing alloys, copper or copper containing alloys, stainless steel, or other etchable metals. A most preferred material being molybdenum.

Figure 4:
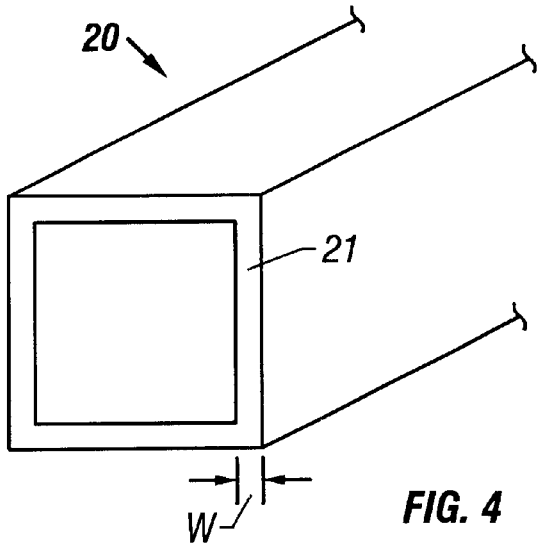

As illustrated in FIG. 4, other preform shapes may be used to construct alternative devices. For example, a square preform 20, having a wall 21 width W may be used.

Figure 5:
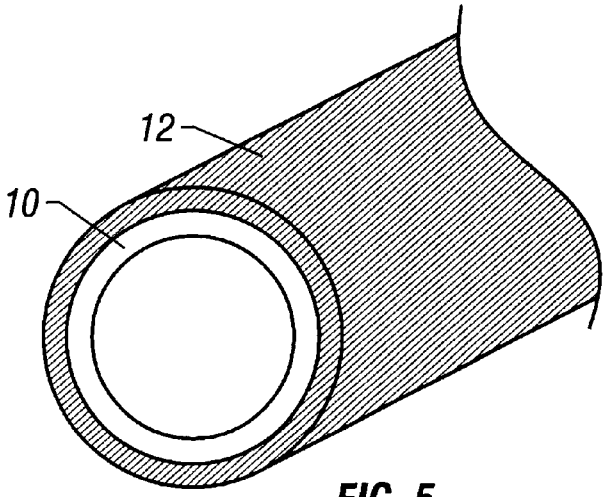
FIG. 5 shows the preform of FIG. 3 after the application of a layer of photoresist.

With reference to FIGS. 2 and 5, once a preform 10 of an appropriate shape and dimension is chosen, the preform 10 is coated with a photresist material 12 (Step 203). The photoresist may be either a positive or negative photoresist depending on the needs of the process engineer. It is critical that the outside surface of the preform 10 be coated with a layer of photoresist material 12.

As illustrated in FIG. 5, a preform 10 has been treated with a layer of photoresist coating 12. A preferred photoresist is a UV developable photoresist such as those manufactured by Shipley Company of Marlborough, Mass. However, other types of photoresist may be used, including negative photoresist and non-UV photoresist's.

Application of the photoresist may be accomplished using a wide range of techniques, including but not limited to, spraying, dip coating, or types of spin coating. However, the preferred embodiment uses electrophoretic application of the photoresist. Electrophoretic application works exceptionally well on three-dimensional structures. Methods of electrophoretic deposition of photoresist are know to those with ordinary skill in the art. One such process is outlined in "Electrophoretic Photoresist Technology: An image of the Future—Today" by D. A. Vidusek; Circuit World, Vol 15, No. 2, (1989) which is hereby incorporated by reference. The photoresist coating 12 is applied to a preferred thickness of about 1 mil. Other thicknesses may be chosen depending on the needs of the process engineer. The resist 12 must be thick enough so that the preform material is completely etched away before the photoresist becomes degraded.

Once the photoresist layer 12 is applied, a mask pattern is formed in the photoresist coating 12. Typically the pattern is formed by optically exposing the photoresist layer 12 then "developing" the photoresist layer to produce a desired mask pattern. Optical exposure (Step 205) may be achieved using a wide range of exposure sources. The particular source chosen is dictated by the needs of the process engineer based on such factors as desired exposure time, choice of photoresist, pattern resolution, desired pattern shape, as well as other considerations known to those having ordinary skill in the art. However, the preferred source is an ultraviolet (UV) laser. Many other lasers or other light sources may be used, such as UV flash lamps. The exposure step (Step 205) is accomplished by placing a photoresist treated preform 10 in an apparatus 40 which will apply a pattern onto the photoresist layer 12. The preform 10 being, for example, a substantially cylindrical hollow tube about 6" in length and having an outer diameter of about 23 mils, is placed in a rotatable chuck 41, then secured. Once secured the preform 10 is treated with the exposure source 42. It is advantageous to use a preform 10 having a length longer than the desired final product. For example, if the final product is a helix of about 4" in length, then a 6" preform is more than adequate. After being secured in the chuck 41 the preform 10 is rotated while at the same time a laser beam 43 is shifted along the length of the preform. A laser beam 43 is directed at the preform projecting a dot onto the photoresist layer. A preferred embodiment uses a laser 43 having a dot having a diameter of about, 7 mils. A satisfactory pattern may be obtained in about 60 to 120 minutes.

The preform 10 is positioned on the apparatus 40 such that the light beam 43 strikes the photoresist layer 12 of the preform 10. The dot produced by the light beam 43 is moved across the surface of the preform 10, in particular, shifting along the length of the preform 10 as the preform 10 is rotated enabling the beam 43 to expose a spiral pattern in the photoresist completely around the outside of the preform 10. The rotation of the preform 10 and the shifting movement of the exposure source 42 is determined by the controller 100. The controller 100 uses a pattern forming encoder which can be either hardware or software driven. The encoder provides instructions which control the rate of rotation of the preform 10 and the rate at which the dot shifts along the length of the preform and whether the exposure source is turned on or off, as well as other parameters. The encoder can be set to expose simple spiral patterns or more complex patterns. The encoder itself can be a simple set of mechanical cams or a more complex encoding apparatus such as a computer control system. Furthermore, the controller can be interactive, allowing the operator to adjust the exposure parameters as the photoresist is being exposed. For example, the controller 100 can be a computer connected to a variable speed motor 45 and the exposure source 42. The operator can supply further pattern forming instructions during pattern forming to adjust whether the exposure source is on, the preform rotation rate, the rate at which the beam moves along the surface of the preform, etc.

Figure 6:
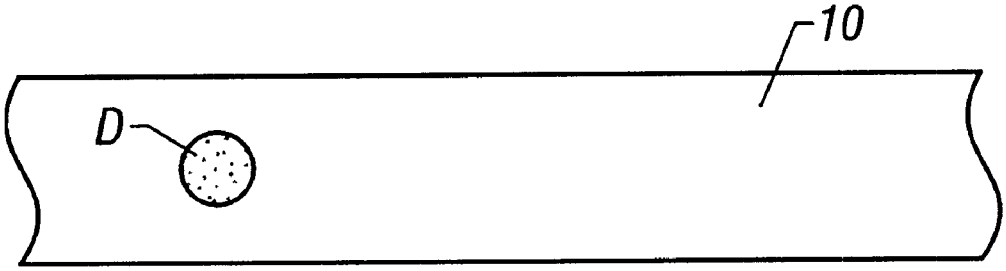
FIG. 6 is a top down view of a portion of the preform shown in FIG. 5 showing a dot caused by an exposure source (e.g. a laser) directed onto a target area of the preform in accordance with the principles of the present invention.
Figure 7:
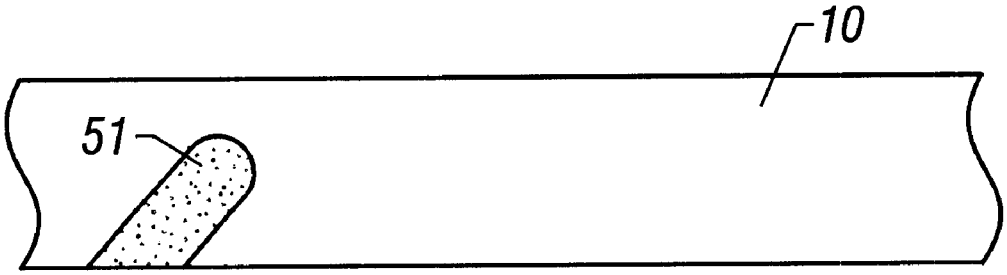
FIG. 7 is a top down view as in FIG. 6 after a portion of the preform surface is treated with an exposure source in accordance with the principles of the present invention.
Figure 8:
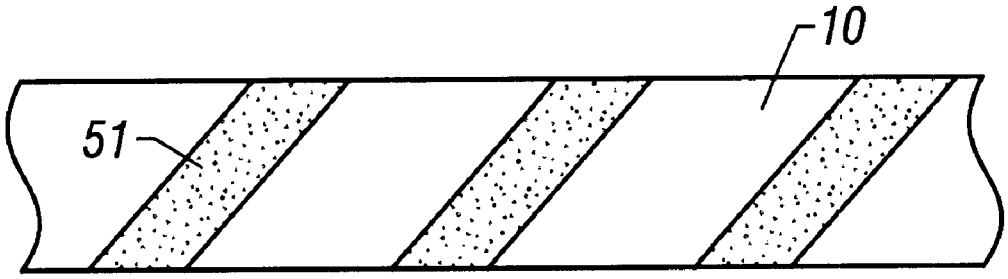
FIG. 8 is a top down view as in FIG. 7 after the entire surface of a preform is treated with an exposure source in accordance with the principles of the present invention.

FIGS. 6, 7, and 8 illustrate the exposure effects of a laser beam 43. In FIG. 6 an impinging laser beam projects a dot D onto a target area on the surface of a preform 10. During the exposure process, the preform 10 is rotated and the laser source is advanced longitudinally across the preform 10. FIG. 6 shows an example of a partial exposure pattern 51 formed by the movement of the dot D across the surface of the preform 10. The exposure area 51 is the region where the laser beam has exposed the photoresist. Once the entire preform 31 is exposed, a spiral pattern like that shown in FIG. 8 is formed.

This exposed preform 10 is then developed (Step 207). In a positive photoresist, the light solublizes the photoresist allowing it to be removed with the appropriate solvent leaving unexposed photoresist in place. In a negative photoresist the opposite is true (the light makes the photoresist insoluble) allowing the unexposed photoresist to be removed. In either case the photoresist forms a desired pattern on the preform. Reference to FIG. 8 shows a typical pattern used to form a helical structure in the preform. After coated the photoresist to a preferred thickness of 1 mil, then exposed to a laser source to form a pattern, the photoresist is developed using an appropriate solvent. For the UV laser photoresist used in the preferred embodiment a satisfactory solvent is lactic acid. Development of such photoresists is known to those having ordinary skill in the art. Typically, such development times are short on the order of about 1–2 minutes.

Figure 9:
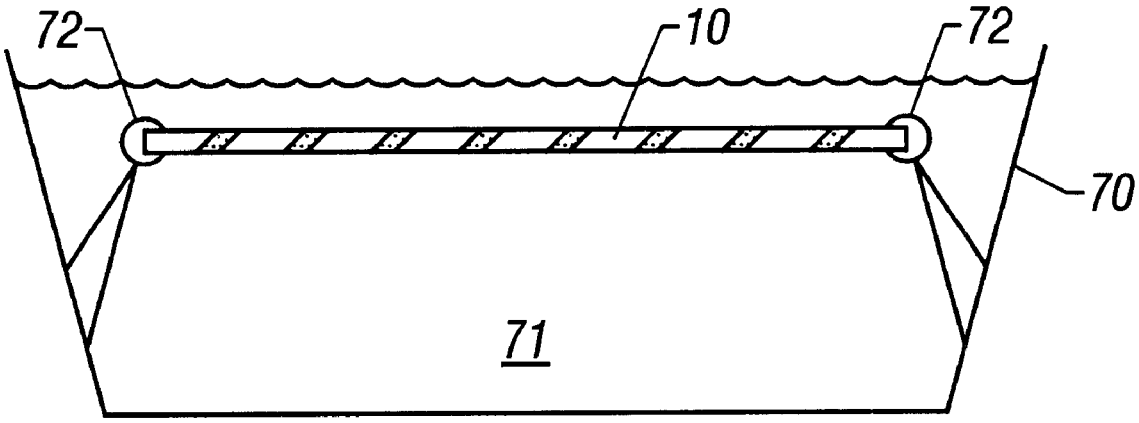
FIG. 9 is a schematic side view of a photoresist treated preform in an etch bath during an etching process in accordance with the principles of the present invention.

Once the preform 10 is developed, leaving a photoresist pattern on the preform surface, further processing is used to remove preform material from the areas of the preform not covered with photoresist (Step 209). One preferred method is by simple chemical etching using enchants optimized to remove the preform material and having good etch selectivity with the photoresist. As shown in FIG. 9, so-called "wet" etching can be simply accomplished by plugging both ends of the preform and placing the photoresist patterned preform 10 in container (an etch bath) 70 filled with etchant 71. Both ends of the preform are plugged 72 using, for example, an elastomer material to prevent entry of the etchant into the interior dimensions of the preform 10. This allows the etchant to act only on the exposed outside surfaces of the preform, preventing the etchant from effecting the area of the preform covered by the photoresist pattern. The preform 10 is preferably suspended in the bath 70 so that all preform surfaces are equally exposed to etchant, enabling even etching of the preform surface. The etch process may be enhanced further by agitating the etch bath. The particular etchants used are dependent on the preform material used. In the case of a molybdenum preform, satisfactory etchants are ferric sulfate, or ammonium ferric sulfate, or potassium hydroxide etchant solutions. Etching times of 10–60 minutes are common, for example, using a potassium hydroxide solution on a molybdenum preform, about 10–15 minutes satisfactorily etches the preform into the desired shape. The principles of the present invention are not limited to particular etchants. Especially, with respect to alternative preform materials, other etchants are commonly used. Additionally, it should be noted that other etching techniques may be used including, without limitation, plasma etching, ion beam etching, and reactive ion etching. After the preform has been etched into the desired shape the preform is removed from the etchant and rinsed using, for example, water followed by a rinse in acetone and isopropyl alcohol. The photoresist is then removed (Step 211). The photoresist is stripped using processes chemicals known to those having ordinary skill in the art. Optionally, a polishing step (Step 213) can be added. For example, the etched preform may be electro-polished by placing the etched preform in a sulfuric acid ($H_2SO_4$) solution which is then neutralized with an ammonium hydroxide ($NH_4OH$) solution to produce a somewhat more polished appearance.

Figure 10:
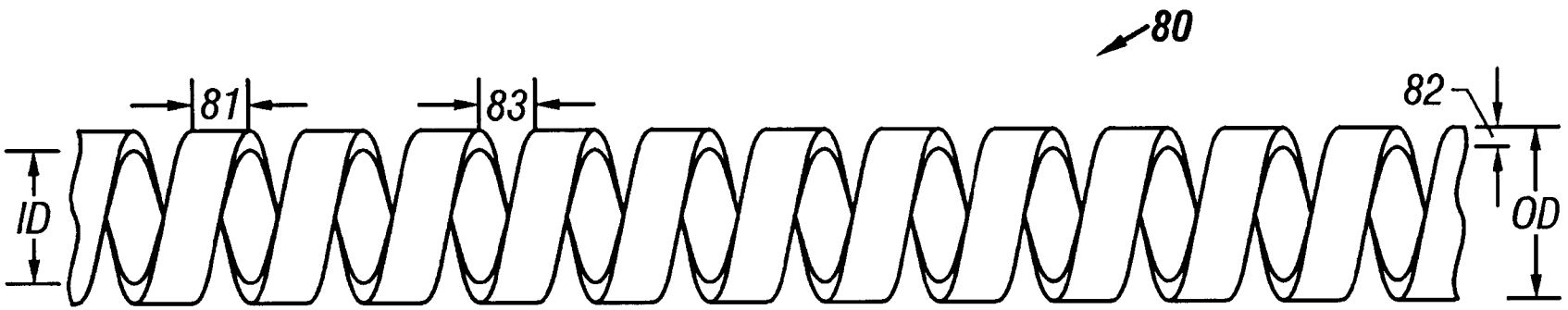
FIG. 10 is a side view of helical circuit structure constructed in accordance with the principles of the present invention.

The end result of such a process is the fabrication of a helical structure 80 of preform material such as that shown in FIG. 10. The helical structure 80 has an outside diameter OD and an inside diameter ID and a plurality of windings each having a width 81 and thickness 82 and having a distance 83 between the windings.

The following preferred embodiment is in no way intended to limit the invention but rather intended to illustrate the principles of the invention. One preferred embodiment is a helix 80 having a length of about 4 inches with a pitch (# of turns of the helix per inch) of about 50 turns per inch and having a winding width 81 of about 0.007 inches and having a distance between windings 83 ranging from about 0.0075 inches to about 0.0081 inches of about and having a winding thickness 82 of about 6 mils. Importantly, the pictured embodiment can be advantageously varied to accommodate a wide variety of circuit needs. For example, in addition to varying the pitch, the winding width 81 and distance between windings 83 can be varied along the length of the helix as needed this includes embodiments where the pitch, the winding width, and distance between windings vary over the length of one circuit element. All that needs be done is to provide the appropriate encoder information to the controller.

The advantage of the methods of the present invention are apparent in the helix 80 of FIG. 10. First, helixes of such small dimension have not been constructed. Helixes constructed using conventional methods are limited to constructing helixes having inside diameters of about 23 mils with outside diameters of about 30 mils or larger. In contrast, the present invention contemplates a helix 80 having an inside diameter ID of about 18 mils and an outside diameter OD of about 32 mils.

Furthermore, structures fabricated using methods embodied by the present invention are not subject to the same mechanical stresses present in conventionally manufactured circuit structures (e.g., those formed using winding processes). These stresses lead to distortion and dimensional instability in circuit structures so fabricated. This is easily detected in circuit structures using coaxial dielectric supports which are intended to remain in physical contact with helical circuit structures which wind around the supports. Thermal relaxation and distortion effects common in these conventionally manufactured circuit structures leads to a physical separation of the circuit structure from the dielectric support. In fact these separations and distortions are commonly on the order of 5 mils.

In contrast, structures fabricated in accordance with the principles of the present invention do not demonstrate the dimensional instability which characterizes conventionally constructed helices. The methods of fabrication and circuit structures embodying the present invention are not subject to mechanical distortion and dimensional instability, but rather, demonstrate excellent dimensional stability and do not become separated from the dielectric support elements even when subject to thermal stress. In fact, the embodiments of the present invention can easily maintain dimensional stability wherein the distortion and instability are less than 3 mils. In most cases the dimensional stability provided by the present invention provides circuit embodiments wherein the distortion effects are less than a mil.

Additionally, due to the extreme precision attainable with a laser source, higher tolerances can be attained in the manufacture of such helixes. This enables greater pitch to be achieved, as well as narrower winding thicknesses 82 and tighter distances between windings 83.

Still more important, TWT circuit shapes and structures which may previously have existed only in theory are now possible to manufacture. For example, one family of advantageous structures now manufacturable are socalled "finned ladder" structures. Such structures are discussed in "Novel High-Grain, Improved-Bandwith, Finned-Ladder V-Band Traveling-Wave Tube Slow-Wave Circuit Design" by C. Kory and J. Wilson, IEEE Transactions on Electron Devices, Vol. 42, No. 9 (September 1995) which is hereby incorporated by reference. Due to manufacturing difficulties no suitable means exists for reliably fabricating these structures. The present invention may be used to construct structures of these dimensions.

Figure 11:
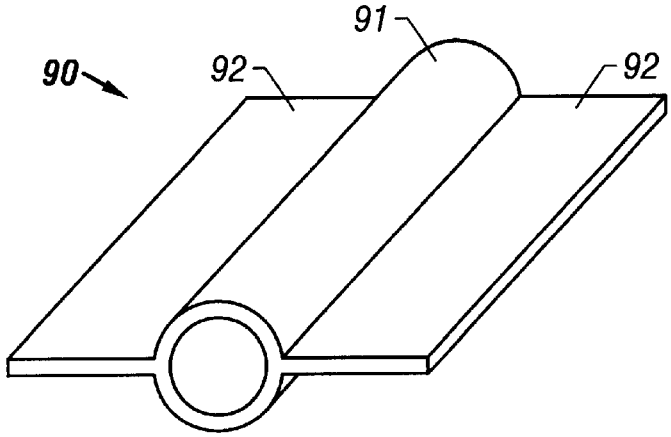
FIGS. 11–15 are perspective views of finned-ladder and slotted finned ladder circuit structures constructed in accordance with the principles of the present invention.
Figure 12:
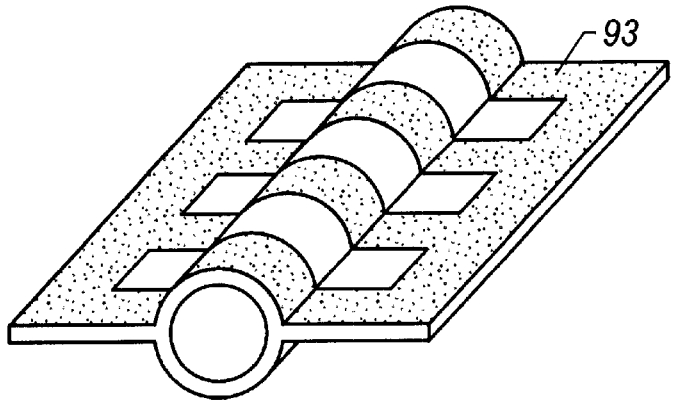
Figure 13:
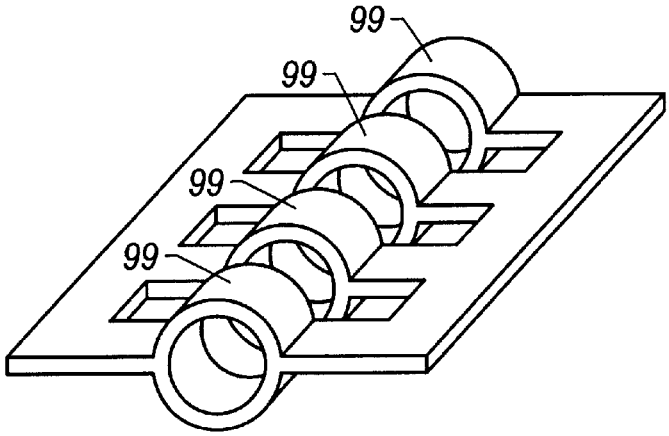
Figure 14:
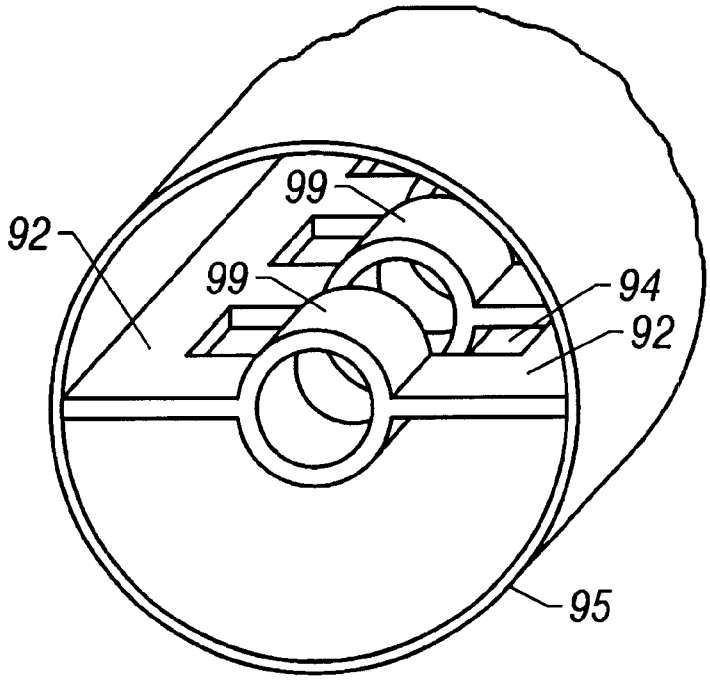

Referring to FIG. 11 an inner preform 90 comprising a hollow tube 91 constructed of the desired preform material having a plurality of planar fins 92 extending radially therefrom is provided. A preferred embodiment includes a hollow tube 91 having an inner diameter of about 18 mils and an outer diameter of about 23 mils. The fins are preferably about 6 mils thick and extend radially outward to contact the outer sleeve preform 95. This basic inner preform 90 is treated and patterned with photoresist 93 (as shown in FIG. 12). The photoresist may be applied and patterned using the methods previously discussed herein with respect to the construction of helical structures. As with the helical embodiment previously discussed, the ends of the inner preform 90 are plugged with an elastomer and then the inner preform 90 is etched. Holes may be etched in the tube 91 and slots 94 etched in the planar fins 92 by any of the methods previously discussed (as shown in FIG. 13). In the pictured embodiment the inner preform 90 is etched to form a series of coaxial rings 99 positioned having spaces therebetween. The slots 94 etched into the planar fins 92 correspond to the spaces between the coaxial rings 99. This etched inner preform 90 is now cooled and slid inside a heated tubular outer sleeve 95. The heat expansion of the outer sleeve preform 95 and the contraction of the cooled inner preform 90 allow an interference fit to be achieved once a stable equilibrium temperature is reached, resulting in the fabrication of a so called "slotted finned-ladder" slow wave circuit (FIG. 14). The above embodiment is merely an illustration of the present invention and is not to be taken as limiting the invention, especially with respect to the precise nature of embodiment dimensions.

Figure 15:
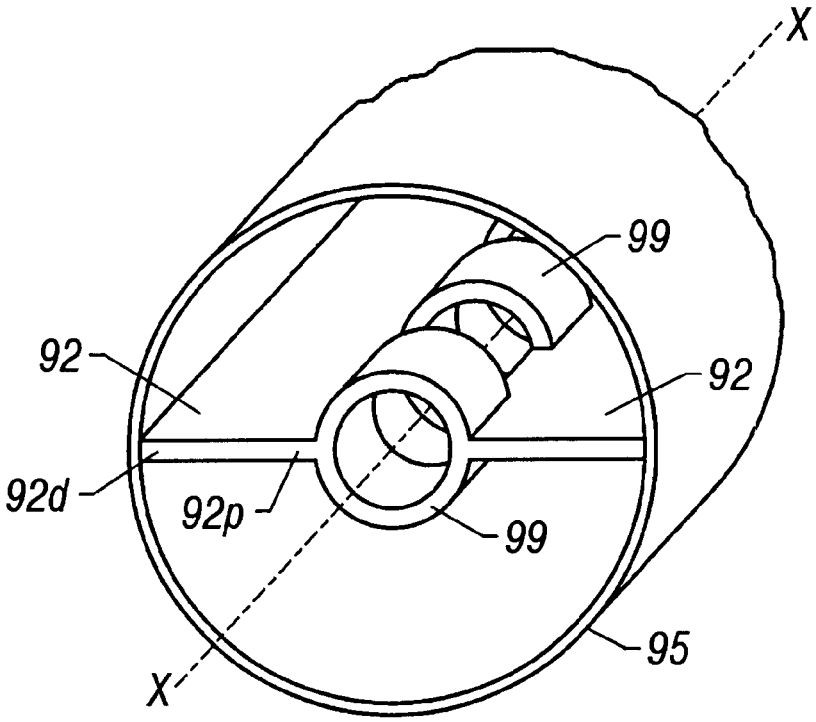
Figure 16:
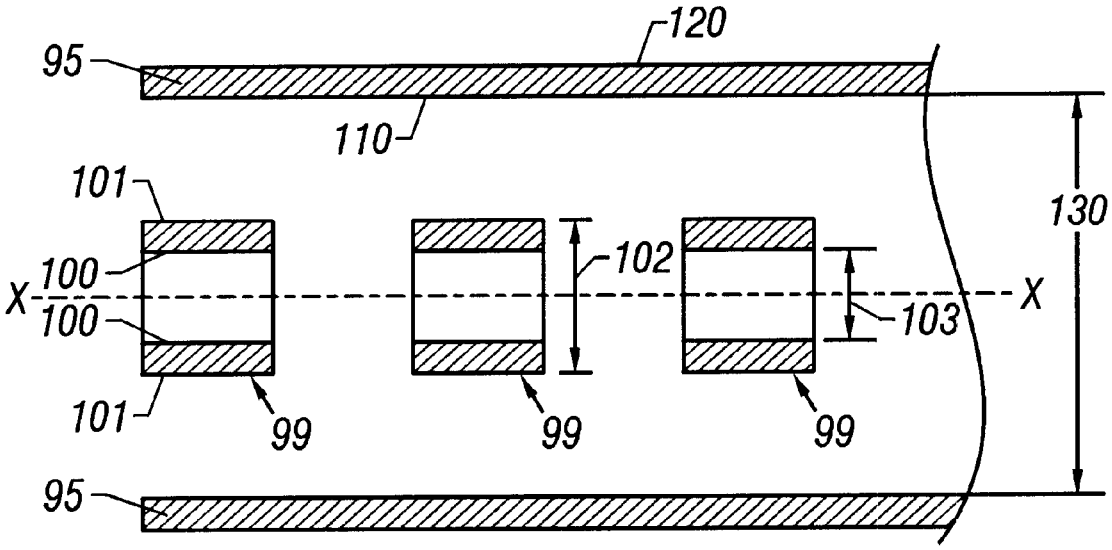
FIG. 16 is a cross section view of the embodiment shown in FIG. 15.

A similar structure is shown in FIGS. 15 and 16. They show a traveling-wave tube circuit having a plurality of hollow cylindrical rings 99. This structure is formed in a similar fashion to that of FIG. 14. i.e., the inner preform is patterned and etched to the desired shape and interference fitted with the outer sleeve to complete the circuit. Each ring 99 having an inside surface 100 and an outside surface 101 and an inside diameter 103 of about 18 mils and an outside diameter 102 of about 23 mils the cylinder wall having a thickness of about 5 mils. The above embodiment merely illustrates the principles of the present invention and is not to be taken as limiting the invention, especially with respect to the precise nature of embodiment dimensions. The rings 99 are positioned such that said rings 99 share a common axis X. Two planar fins 92 extend radically outward from the rings 99. Each fin 92 having a proximal end 92*p* and a distal end 92*d* is positioned such that proximal 92*p* of the fins 92 are in contact with the outside surfaces of said rings 99 extending radically outward from the rings 99. A cylindrical outer sleeve 95 having an inside surface 110 and an outside surface 120 and a diameter 130 larger than said ring 99 outer diameter 101 is positioned coaxially with said rings 99 and positioned such that the distal ends 92*d* of said fins 92 are in contact with the inside surface 110 of said sleeve 95. Again, as with the embodiment of FIG. 14 the inner preform is cooled and slid inside a heated outer sleeve.

Figure 17:
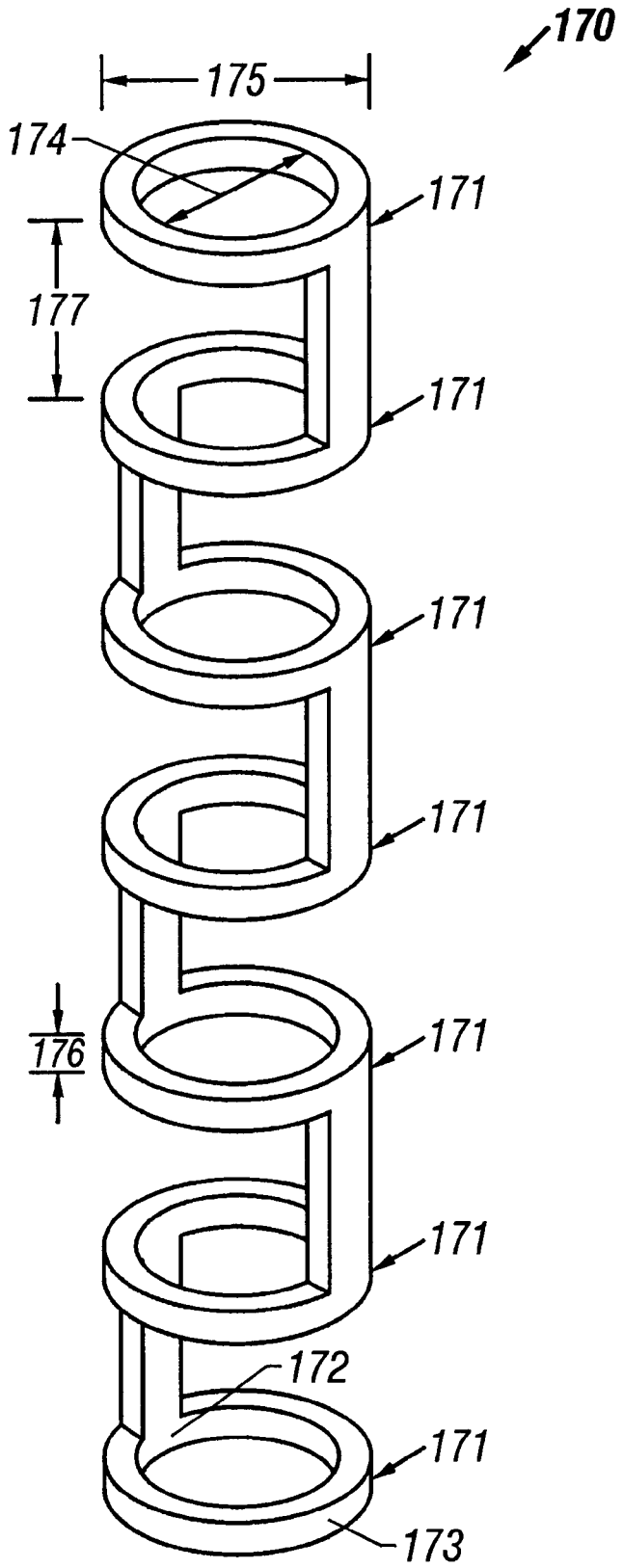
FIG. 17 is a perspective view of a "ring bar" circuit embodiment.

Another embodiment advantageously constructed in accordance with the principles of the present invention is shown in FIG. 17. The pictured embodiment is a "ring-bar" traveling-wave tube circuit 170 which is related to the family of helical structures disclosed herein, specifically, a contrawound helix. This structure is formed in a similar fashion to that of the other previously described structures. A preform is patterned and etched to the desired shape to complete the circuit. Each ring 171 having an inside surface 172 and an outside surface 173 and an inside diameter 174 having a preferred diameter of about 18 mils and a preferred outside diameter 175 of about 23 mils. The above embodiment merely illustrates the principles of the present invention and is not to be taken as limiting the invention, especially with respect to the precise nature of embodiment dimensions. The rings 171 are positioned such that they share a common axis. The precise spacing between the rings 177, and ring width 176 are dependent (as are the other dimensions) on the operating frequency.

Until now circuits such as those described above could not be constructed at all. Furthermore, the inventors contemplate that the principles of the present invention may be used to form a variety of other three dimensional structures not previously possible.

The present invention has been particularly shown and described with respect to certain preferred embodiments and features thereof. It is to be understood that the shown embodiments are the presently preferred embodiments of the present invention and as such are representative of the subject matter broadly contemplated by the present invention. The scope of the invention fully encompasses other three dimensional circuit structures not expressly referred to as well as embodiments which may become obvious to those skilled in the art, and are accordingly to be limited by nothing other than the appended claims, in which reference to an element in the singular is not intended to mean "one and only one" unless explicitly stated, but rather "one or more". All structural and functional equivalents of the elements of the above-described preferred embodiment that are known or later come to be known to those of ordinary skill in the art are expressly incorporated herein by reference and are intended to be encompassed by the present claims. Moreover, it is not necessary for a device or method to address each and every problem solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, paragraph 6, unless the element is expressly recited using the phrase "means for".

What is claimed is:

1. A method for fabricating three dimensional traveling wave tube elements comprising the steps of:

providing a hollow preform comprising a desired material wherein the hollow preform has a wall with a prescribed thickness, the thickness defining an outer diameter and an inner diameter, the inner diameter being hollow;

coating an outside surface of the hollow preform with a photoresist material;

providing exposed and unexposed portions of the wall of the hollow preform by removing portions of the photoresist material, the exposed portions of the wall having the prescribed thickness; and removing the exposed portions of the wall having the prescribed thickness wherein the unexposed portions of the hollow preform remain with a prescribed shape.

2. The method of claim 1 further comprising removing the photoresist material from the unexposed portions.

3. The method of claim 1 wherein the step of removing the prescribed exposed portions of the wall having the prescribed thickness comprises removing the prescribed thickness by etching the exposed portions of the hollow preform.

4. The method of claim 1 wherein the step of providing a hollow preform comprises providing a hollow preform with the wall having the prescribed thickness, the prescribed thickness defining the inner diameter and the outer diameter, wherein the step of removing the exposed portions of the wall having the prescribed thickness comprises leaving the unexposed portions of the wall of the hollow preform wherein the unexposed portions of the wall of the hollow preform have the prescribed thickness and define the inner diameter and the outer diameter.

5. The method of claim 1 wherein the step of removing the exposed portions of the wall having the prescribed comprises plugging the ends of the hollow preform and wet etching the exposed portions of the wall.

6. The method of claim 1 further comprising the step of:

directing a light beam from an optical source on to the photoresist material while rotating the hollow preform and moving the optical source along a surface of the photoresist material thereby exposing a pattern in the photoresist material;

wherein the step of providing exposed and unexposed portions of the hollow preform comprises developing the photoresist material thereby providing the exposed portions with a prescribed pattern.

7. The method of claim 1 wherein the step of coating the hollow preform comprises electrophoretic application of the photoresist material to the hollow preform.

8. The method of claim 1 wherein the step of providing the hollow preform comprises providing a larger hollow preform and reducing a larger thickness of the larger hollow preform to the prescribed thickness in advance of coating the hollow preform with the photoresist material.

9. The method of claim 1 wherein the step of providing the hollow preform comprises providing the hollow preform wherein the desired material is selected from the group consisting of molybdenum, copper and stainless steel.

10. The method of claim 1 wherein the step of removing the exposed portions of the wall having the prescribed thickness comprises etching the prescribed thickness of the exposed portions wherein the etching is carried out by an etching technique selected from the group consisting of ion milling, reactive ion etching and plasma etching.

11. A method of making a three dimensional structure from a desired material comprising the steps of:

providing a hollow preform comprising the desired material wherein the hollow preform has an inner diameter and an outer diameter, the inner diameter and the outer diameter defining a thickness, the inner diameter being hollow;

applying a coating to an outside surface of the hollow preform;

removing a pattern of the coating leaving an exposed pattern of the hollow preform comprising the desired material;

etching through the thickness of the hollow preform at the exposed pattern of the hollow preform leaving the three dimensional structure having a prescribed shape.

12. The method of claim 11 further comprising removing the coating from the three dimensional structure wherein the three diminsional structure comprises the desired material, wherein the three diminsional structure has the inner diameter and the outer diameter.

13. The method of claim 12 further comprising the step of:

polishing the three dimensional structure after the coating is removed from the three dimensional structure.

14. The method of claim 11 wherein the step of providing a hollow preform comprises providing a square preform.

15. The method of claim 11 wherein the step of etching through the thickness of the hollow preform at the exposed pattern of the hollow preform comprises wet etching the exposed pattern of the hollow preform and plugging the ends of the hollow preform to prevent entry of etchant into interior dimensions of the hollow preform.

16. The method of claim 11 further comprising the step of:

directing a light beam from an optical source onto the coating while rotating the hollow preform and moving the optical source along a surface of the coating, wherein the coating is a photoresist material thereby exposing a pattern in the coating, thereby developing the photoresist material, thereby providing the exposed pattern.

17. The method of claim 11 wherein the step of applying a coating to the hollow preform comprises electrophoretic application of the coating to the hollow preform, wherein the coating is a photoresist material.

18. The method of claim 11 wherein the step of providing a hollow preform comprises providing a larger hollow preform and reducing the size of the larger hollow preform to the inner and outer diameters of the hollow preform in advance of applying the coating to the hollow preform.

19. The method of claim 11 wherein the step of providing a hollow preform comprises a providing hollow preform wherein the desired material is selected from the group consisting of molybdenum, copper and stainless steel.

20. The method of claim 11 wherein the step of etching through the exposed pattern of the hollow preform comprises etching away the exposed pattern with an etching technique selected from the group consisting of ion milling, reactive ion etching and plasma etching.

* * * * *

UNITED STATES PATENT AND TRADEMARK OFFICE

CERTIFICATE OF CORRECTION

PATENT NO. : 6,584,675 B1
DATED : July 1, 2003
INVENTOR(S) : Rajan et al.

It is certified that error appears in the above-identified patent and that said Letters Patent is hereby corrected as shown below:

Column 12,
Lines 3 and 4, change “diminsional” to -- dimensional --
Line 37, change “a providing” to -- providing a --

Signed and Sealed this

Twenty-fourth Day of February, 2004

JON W. DUDAS
*Acting Director of the United States Patent and Trademark Office*